US007047711B2

(12) United States Patent
Ballestrazzi et al.

(10) Patent No.: US 7,047,711 B2
(45) Date of Patent: May 23, 2006

(54) DEVICE FOR THE AUTOMATIC INSERTING OF PRODUCTS INTO ENVELOPES

(75) Inventors: Aris Ballestrazzi, Savignano sul Panaro (IT); Lamberto Tassi, Savignano sul Panaro (IT)

(73) Assignee: Sitma S.p.A., Modena (IT)

( * ) Notice: Subject to any disclaimer, the term of this patent is extended or adjusted under 35 U.S.C. 154(b) by 45 days.

(21) Appl. No.: 10/939,698

(22) Filed: Sep. 13, 2004

(65) Prior Publication Data

US 2005/0060966 A1 Mar. 24, 2005

(30) Foreign Application Priority Data

Sep. 19, 2003 (IT) ..... MI2003A1794

(51) Int. Cl.
*B65B 5/04* (2006.01)
*B65B 39/12* (2006.01)
*B65B 43/30* (2006.01)
*B65B 25/14* (2006.01)

(52) U.S. Cl. ..... 53/569; 53/259; 53/284.3; 53/381.7

(58) Field of Classification Search ..... 53/259, 53/284.3, 381.6, 569
See application file for complete search history.

(56) References Cited

U.S. PATENT DOCUMENTS 4,081,096 A * 3/1978 Kupcikevicius ..... 53/473
4,338,762 A * 7/1982 Gilligan et al. ..... 53/244
4,464,880 A * 8/1984 Peters et al. ..... 53/493
5,081,825 A * 1/1992 Mrozinski ..... 53/569
5,211,384 A * 5/1993 Orsinger et al. ..... 270/59
5,447,015 A * 9/1995 Belec et al. ..... 53/492
5,642,598 A * 7/1997 Cannaverde ..... 53/284.3
5,651,238 A * 7/1997 Belec et al. ..... 53/504
6,155,031 A * 12/2000 Ballestrazzi et al. ..... 53/569

FOREIGN PATENT DOCUMENTS

EP 1 332 891 8/2003
WO WO 02/87973 11/2002

* cited by examiner

*Primary Examiner*—John Sipos
(74) *Attorney, Agent, or Firm*—Hedman & Costigan

(57) ABSTRACT

Device (11) for the automatic inserting of printed products or sheets (12) in individual envelopes (13), where the individual printed products or sheets (12) are fed by one or more feeders and the envelopes (13) are arranged piled up in a storage container (16) equipped with at least one gripping element (17, 18, 19) for feeding an individual envelope (13) between a first upper conveyor belt (20) and a first lower conveyor belt (21) facing each other to define a feeding group of the envelope (13) towards an inserting of products into envelopes zone, also foreseeing a second upper conveyor belt (15) and a second lower conveyor belt (14) facing each other to advance the printed products or sheets (12) one after the other, a nozzle (22) being associated with the first conveyor belts (20, 21) for opening and flipping back a tab (24) of the envelope (13) taken out from the storage container (16), the second conveyor belt (14) foreseeing an end (37) that can move forwards and backwards with respect to a sucked conveyor belt (35) aligned downstream of the conveyor belt (14) to define an opening (38) of variable size, at the opening (38) being foreseen a gripping element (39) of the tab (24) and at an initial portion of the sucked conveyor belt (35) being foreseen a gripping element (40) of the mouth of the envelope (13) locked onto the sucked conveyor belt (35) and introducing elements (45) that can be inserted over the tab (24) and inside the mouth of the envelope.

14 Claims, 11 Drawing Sheets

DEVICE FOR THE AUTOMATIC INSERTING OF PRODUCTS INTO ENVELOPES

The present invention refers to a device for the automatic inserting of products into envelopes. Currently, numerous machines that take care of the introduction of printed products or sheets in general into envelopes are foreseen. In these known machines the introduction of printed products or sheets is carried out through mechanical thrusters that act upon the rear part of them and introduce them into the envelope that is opened.

These known apparatuses do not allow automatic inserting of products into envelopes at high speeds since they have limitations due both to the advance of the single envelope, and its opening, as well as above all due to the introduction into the envelope, once opened, of the printed product or of the preselected sheet.

In particular, the problems currently encountered concern the fact that the thrusters do not easily feed the printed product or sheet, made from light material, since the printed product or sheet tends to fold or jam, becoming ruined during the course of the thrusting introduction operation. Moreover, it is not always possible to carry out both a complete and satisfactory opening of the envelope to allow the introduction of the printed product or of the sheet and a suitable timing of feeding of the printed product or sheet into the envelope, when it is suitably opened.

All of these drawbacks mean extremely complex inserting of products into envelopes cycles carried out at low speeds, as well as the occurrence of possible stopping of the machine due to breaking of the envelope or part of it and/or due to folding of the printed product or sheets and their breaking.

Therefore, the general purpose of the present invention is that of identifying and making a device for the automatic inserting of products into envelopes that allows all of the aforementioned technical problems to be solved.

Another purpose of the invention is that of making a device for the automatic inserting of products into envelopes of the type indicated above that works in the presence of large thicknesses and sizes of the printed product or sheet, without any problem.

Another purpose of the invention is that of making a device for the automatic inserting of products into envelopes that allows a substantial saving of inserting of products into envelopes time to be attained, whilst still carrying out a correct and precise arrangement of any printed product or sheet inside each envelope. Yet another purpose is that of identifying a device that makes the execution of the inserting of products into envelopes operations as automatic and quick as possible.

These and other purposes according to the present invention are accomplished by realising a device for the automatic inserting of products into envelopes as outlined in the attached claim 1.

Further relevant characteristics of the present invention are the object of the dependent claims. Through a device according to the present invention a solution is thus achieved for always correct inserting of printed product or of sheets into envelopes that arrive one after the other spaced apart on a conveyor belt, unloaded by feeders or similar devices, which allow their insertion into each single envelope, also fed by a device similar to a feeder.

The functional and structural characteristics and the advantages of a device according to the invention shall become clearer from the description of a non-limiting embodiment thereof, with reference to the attached drawings, in which:

FIG. 1 schematically shows, in a top side view, a device for the automatic inserting of products into envelopes according to the invention inside an inserting line of products into envelopes;

Figure 1:
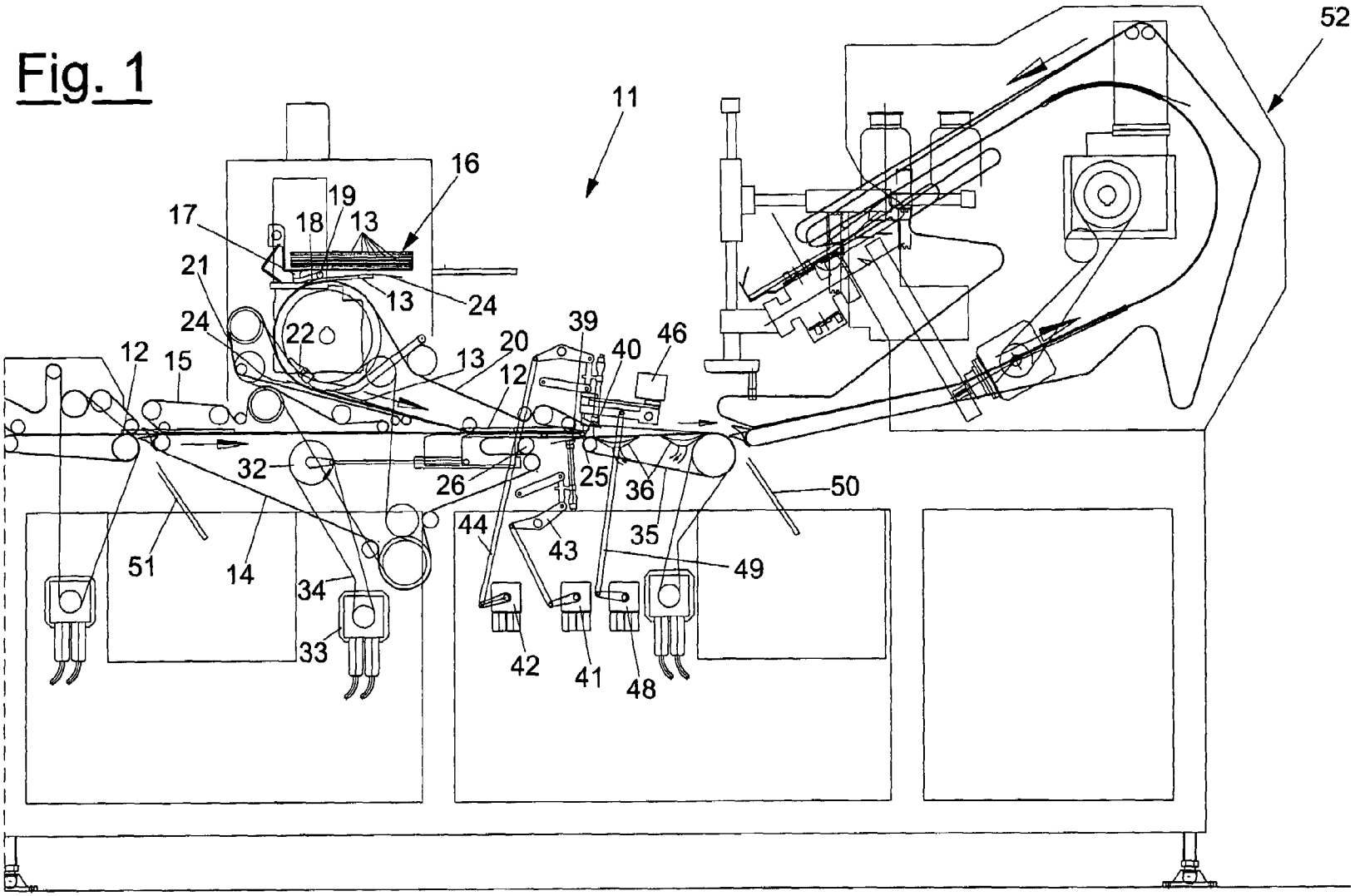
Figure 2:
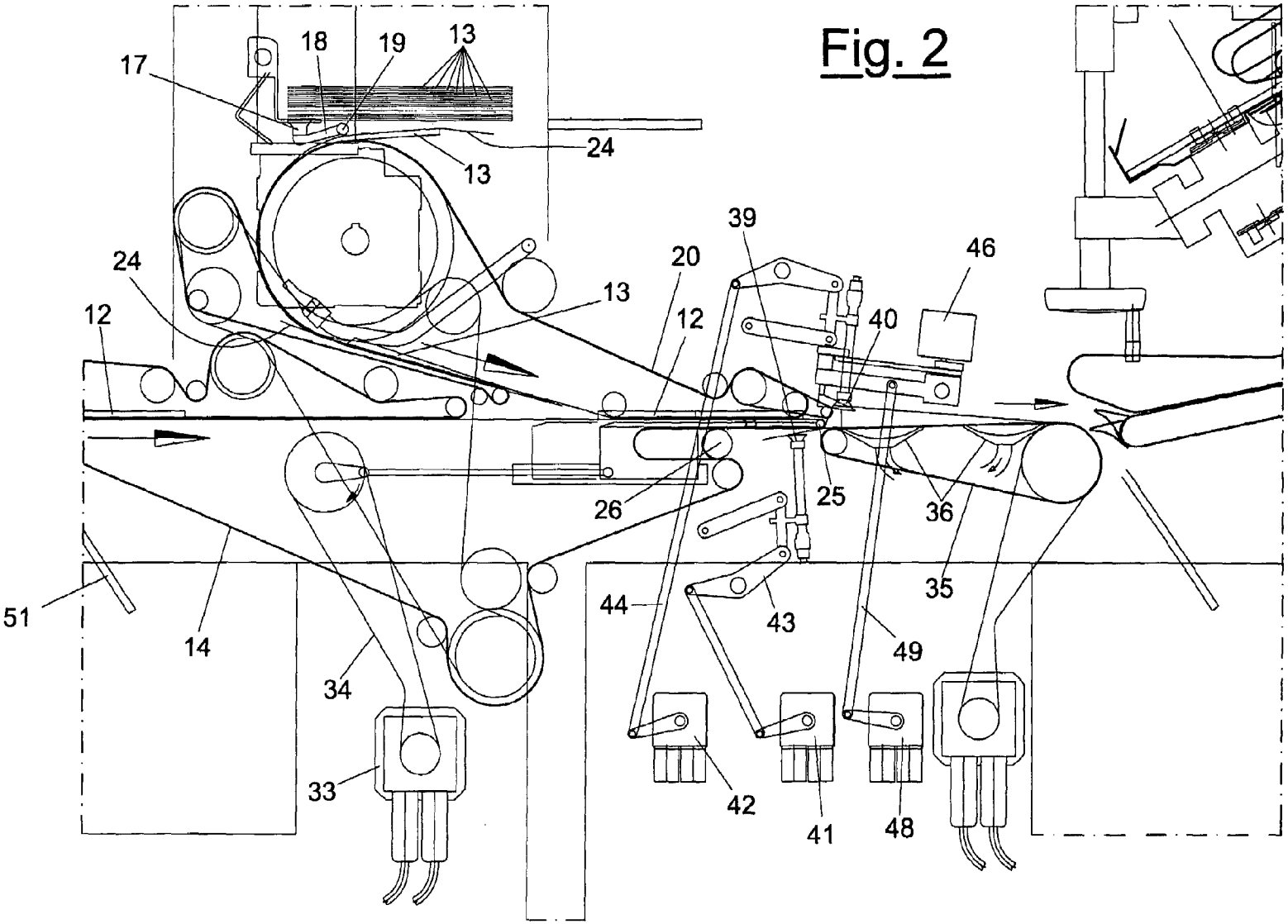
FIG. 2 is an enlarged top side view of the inserting of products into envelopes device.
Figure 3:
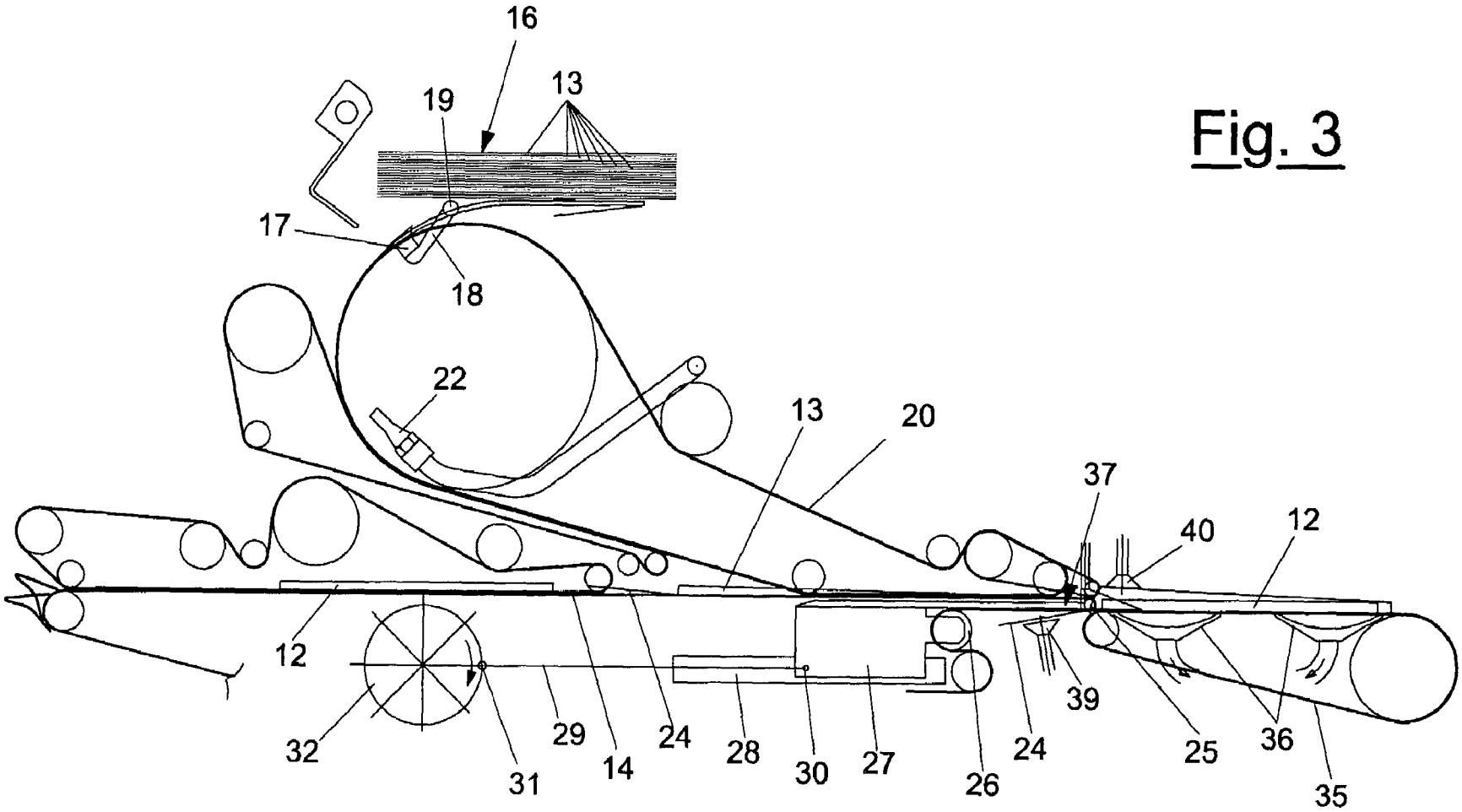
FIGS. 3–9 show schematic top views of the successive steps of the inserting of products into envelopes operation carried out through the device.
Figure 4:
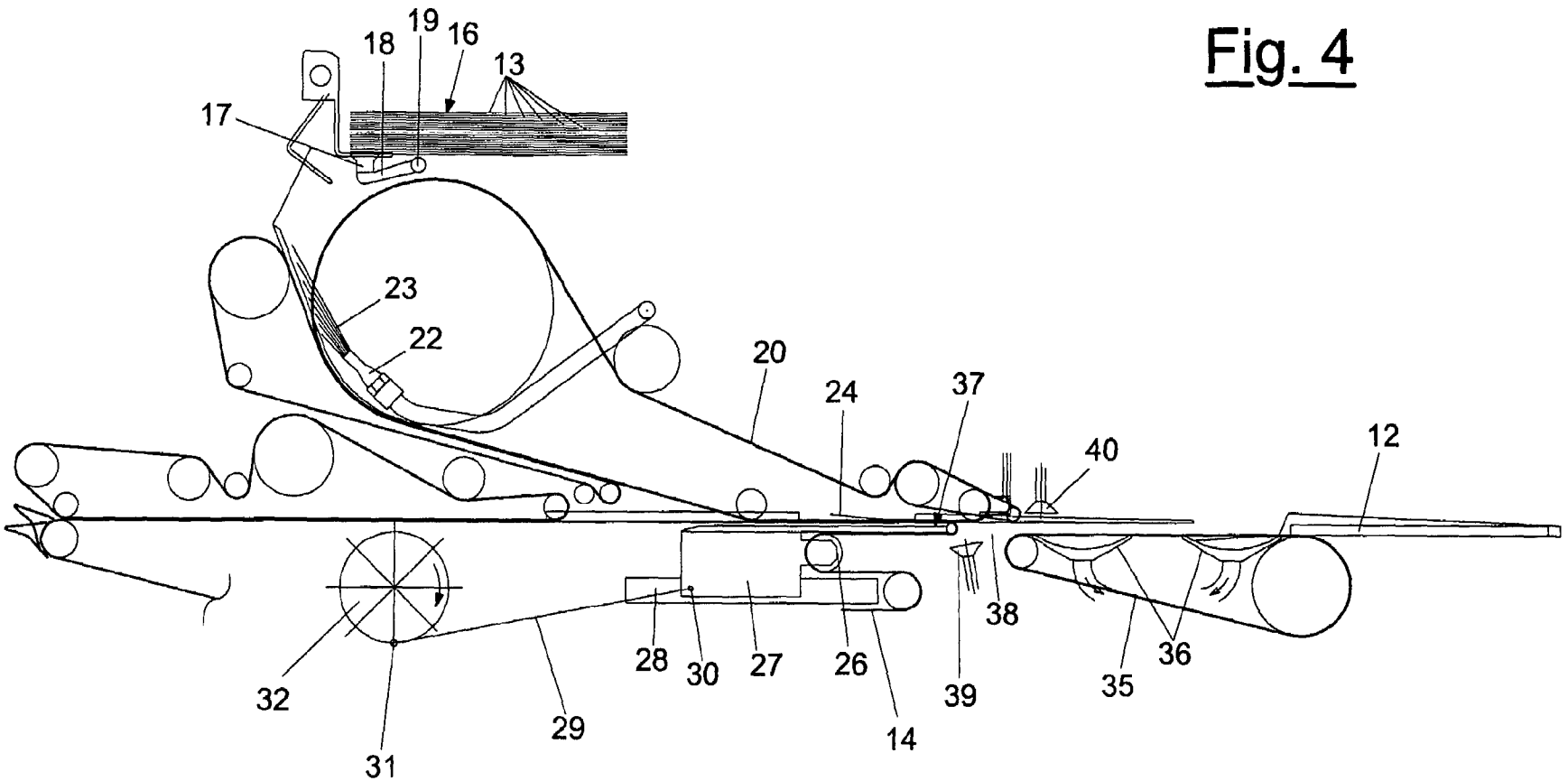
Figure 5:
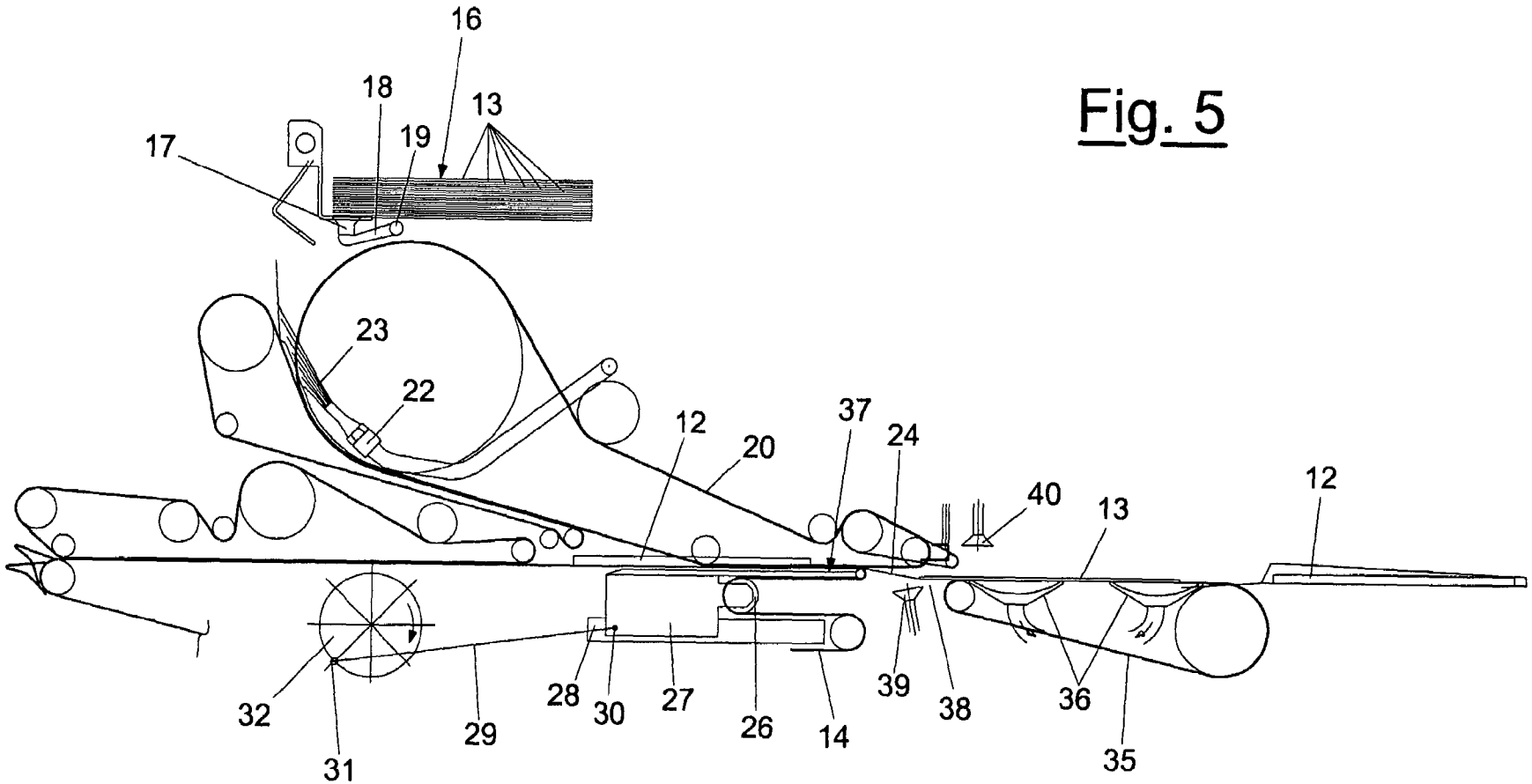
Figure 6:
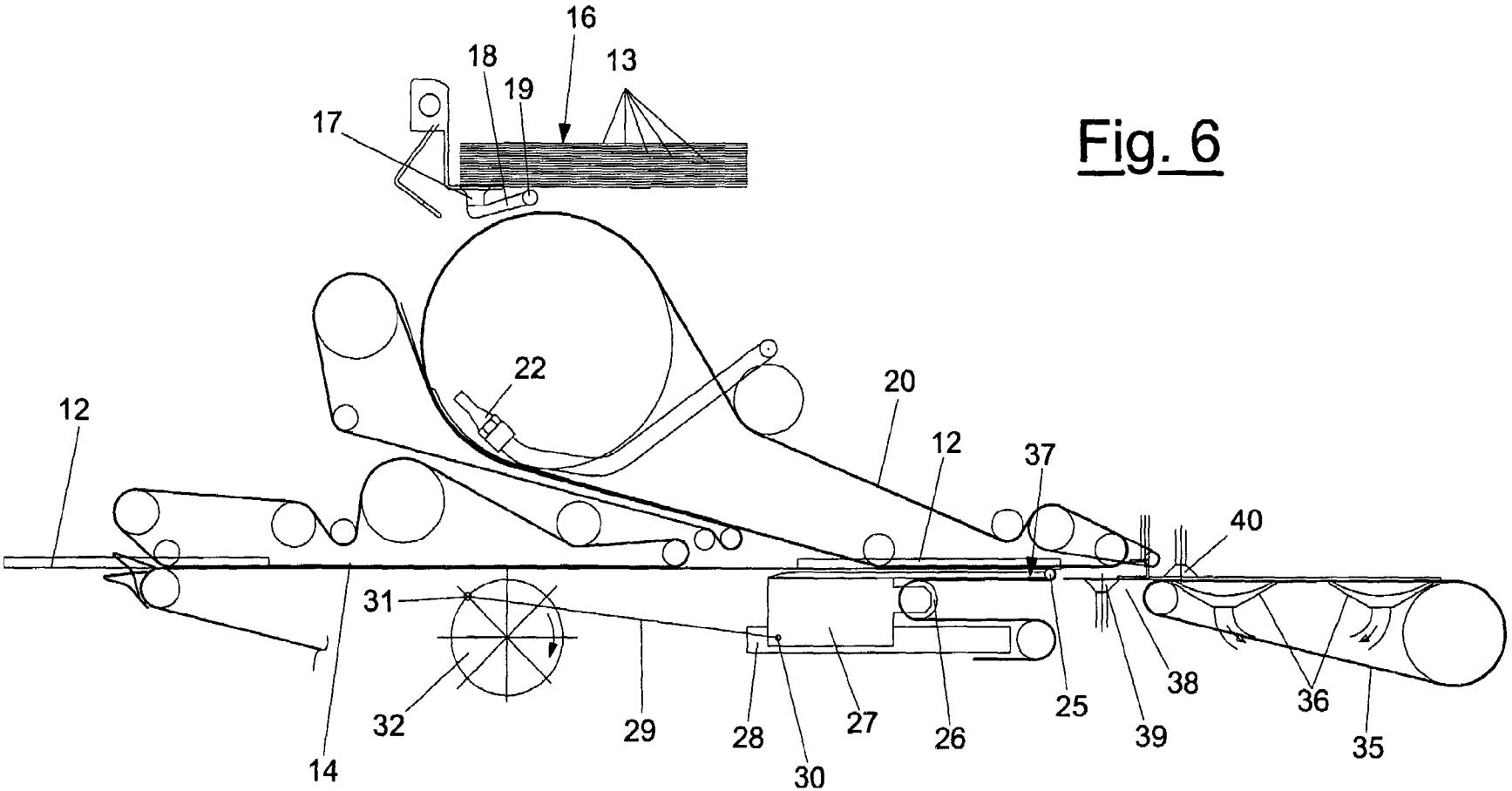
Figure 7:
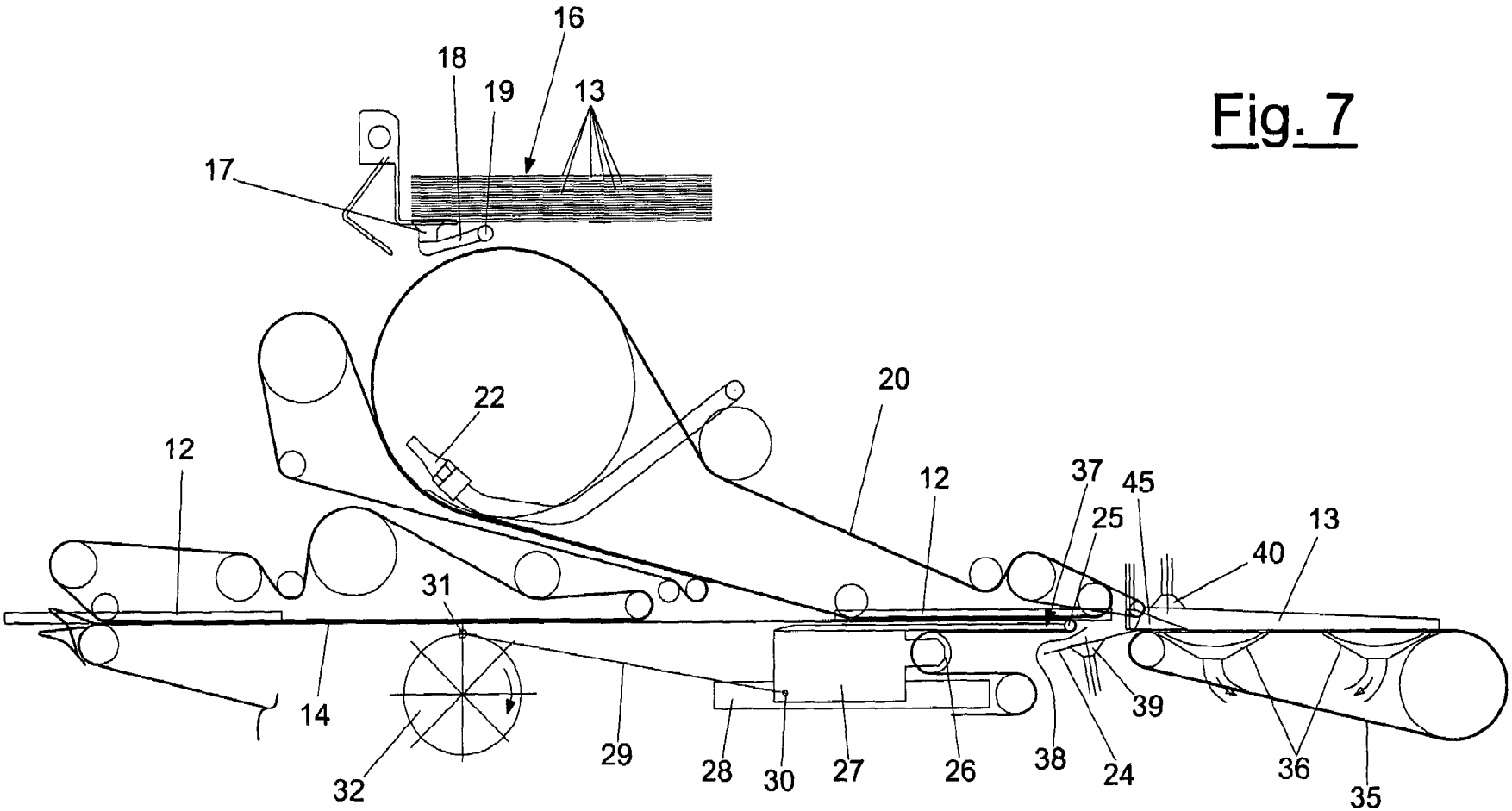
Figure 8:
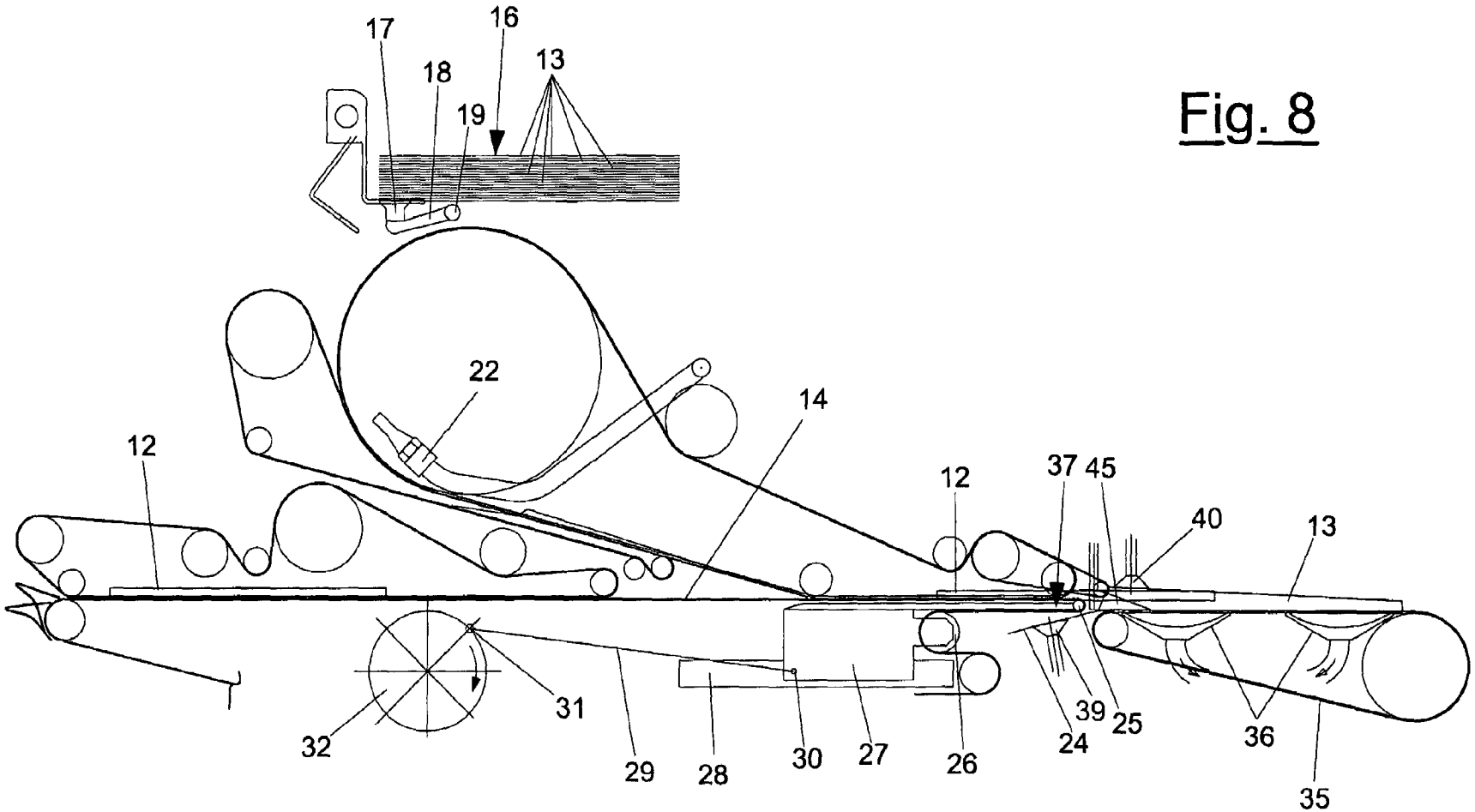
Figure 9:
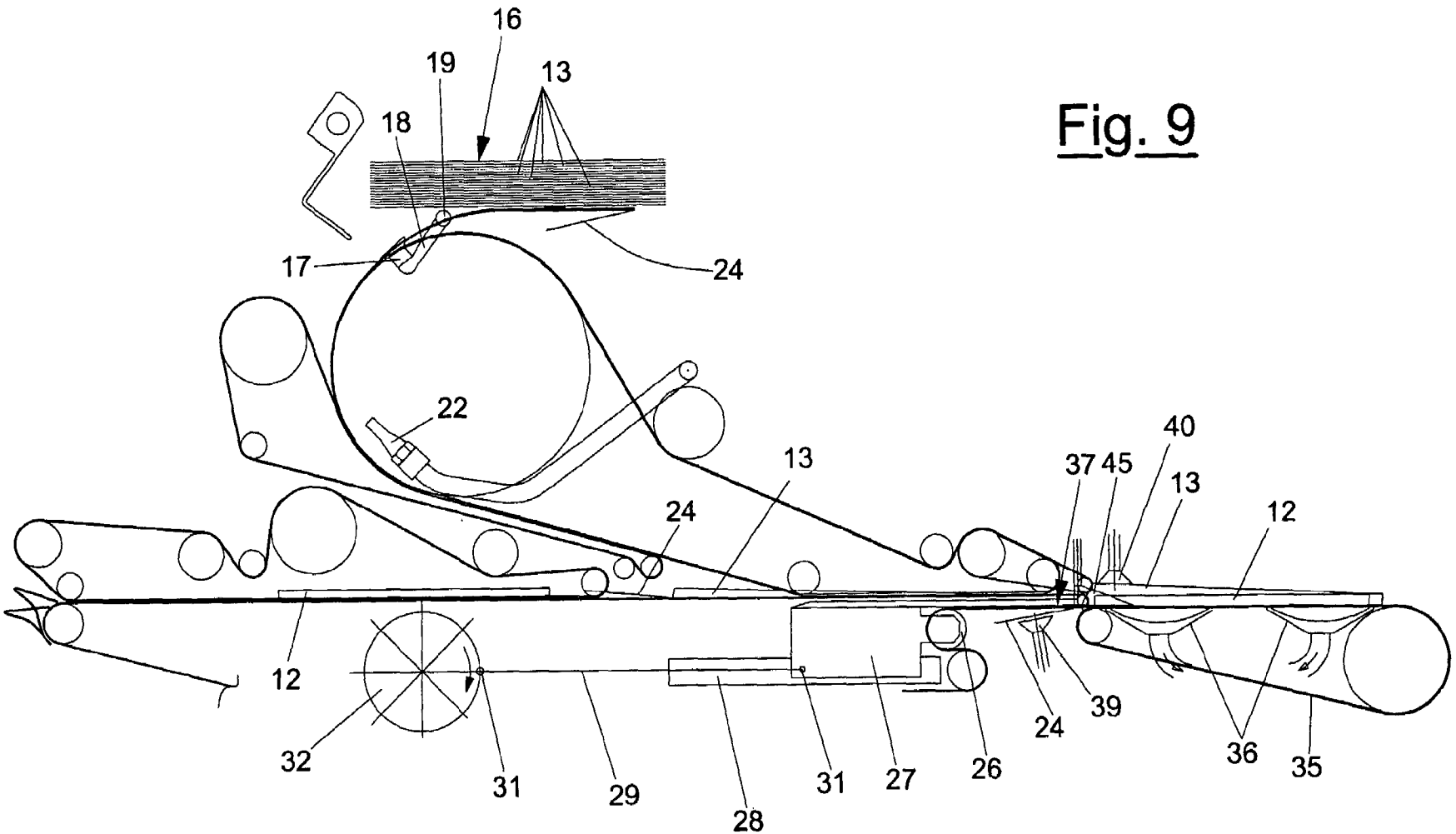
Figure 10:
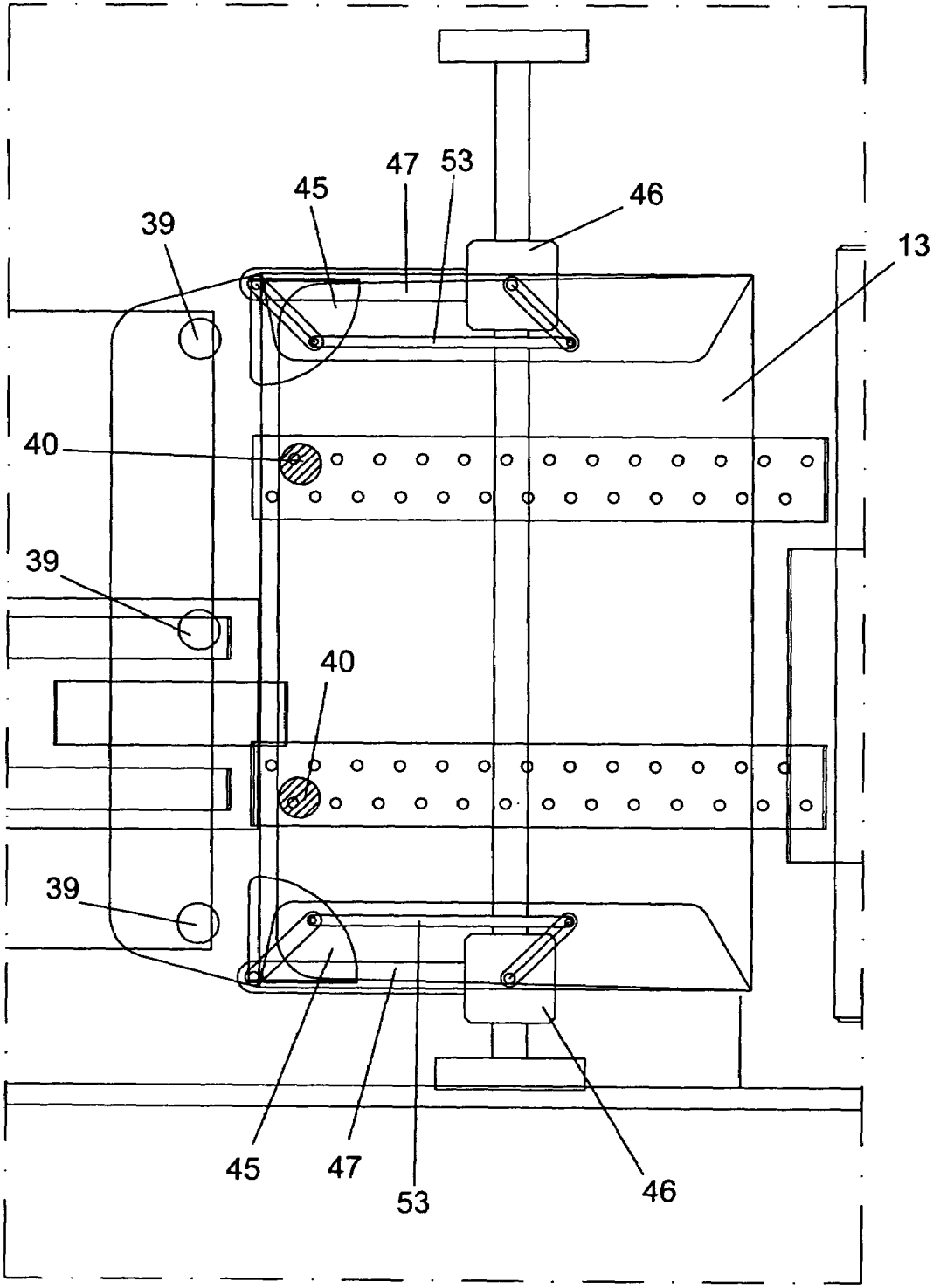
FIGS. 10 and 11 show top and plan views from above of introducing elements forming part of the device of the invention.

With reference to the drawings, a device 11 for the automatic inserting of one or more products into envelopes, such as printed product or sheets 12, according to the present invention, into individual envelopes 13 is shown.

The printed product or sheets 12 are fed, in the predetermined number, between a pair of conveyor belts 14 and 15 and are arranged in one or more feeders (not shown) positioned upstream of the inserting of products into envelopes device 11. The envelopes 13, on the other hand, are arranged in a pile in a storage container 16 situated above the conveyor belts 14 and 15. Below the pile a gripping element, such as at least one suction cup 17, is arranged connected to a vacuum source, applied to an arm 18 oscillating about a pin 19. which grips the individual envelope by sucking it and feeds it onto a conveyor belt 20. This conveyor belt 20 at the top faces a further conveyor belt 21 so as to define a feeding group of the envelope 13 towards the inserting of products into envelopes zone.

In collaboration with the conveyor belts 20 and 21 and with the gripping element 17–19 a nozzle 22 is arranged that supplies a blow of air, schematised at 23, towards the envelope partially locked between the two conveyor belts 20 and 21. The blow of air 23 emitted by the nozzle 22 licks the outer surface of the envelope 13 and makes a closing tab 24 of the envelope open in rotation and flip back to free a mouth of the envelope. An end of the conveyor belt 14 is arranged to wind between a pair of rollers 25 and 26 on which the aforementioned conveyor belt winds in an S-shape. The two rollers 25, 26, with respect to the other rollers on which the conveyor belt winds that are able to rotate but not translate, are arranged on a displaceable cursor 27 so that they an slide horizontally below the upper branch of the conveyor belt 14 that supports and advances both the printed products or sheets 12 and the individual envelopes 13. More specifically, such a cursor 27 is commanded into a movement forwards and backwards on a guide 28 through a connecting rod 29. The connecting rod 29 at one end is hinged at 30 to the cursor 27 and at the other end is hinged at 31 to a rotating disc 32 commanded into rotation by a respective motor reducer 33 with interposition of a transmission 34. An end 37 of the conveyor belt 14 that can move forwards and backwards is thus made.

Aligned downstream of the conveyor belt 14 a sucked conveyor belt 35 is arranged, for example made through a belt provided with holes, which in an upper branch thereof slides above suction cases 36 in which the vacuum is made. Such a sucked conveyor belt 35, together with the displaceable end 37 of the conveyor belt 14 define an opening 38 of variable size in which, as described hereafter, the tab 24 of the envelope 13 is arranged.

At this opening 38, in the lower part of the advancing plane of the printed products or sheets 12 and of the envelopes 13, a lower suction cup 39 is arranged that acts as a gripping element of the tab 24 of the envelope thanks to the fact that it is connected to a vacuum source. At the initial portion of the sucked conveyor belt 35, above it, an upper suction cup 40 is arranged, also connected to a vacuum source, which acts as a gripping element and opening element of the mouth of the envelope 13. The lower suction cup 39 and the upper suction cup 40 are actuated in their movement towards and away from the tab 24 and the mouth of the envelope 13, respectively, through respective motor reducers 41 and 42. These motor reducers 41 and 42, indeed, command levering transmissions 43 and 44 that carry the suction cups 39 and 40 at their ends.

Figure 11:
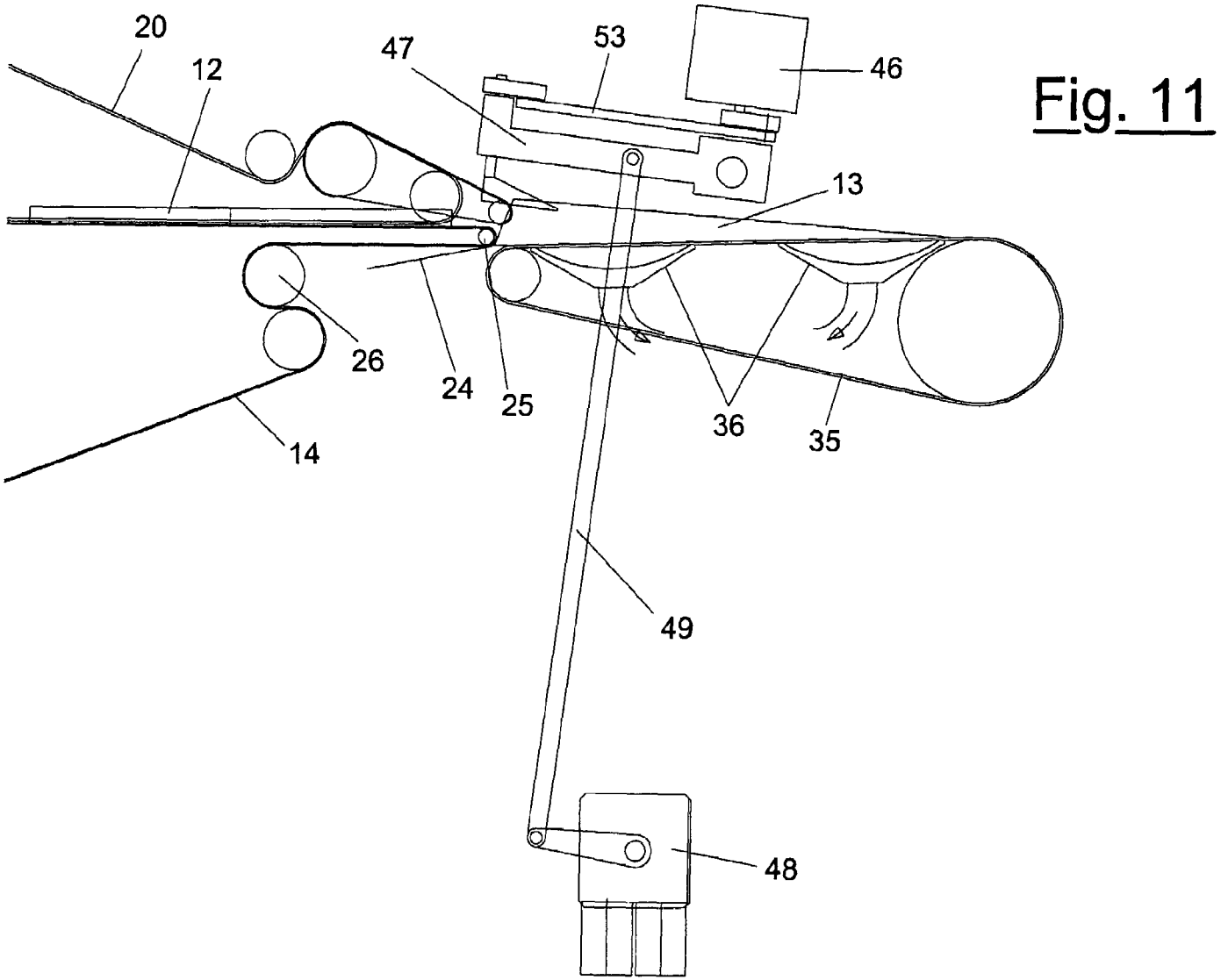

Moreover, two mobile introducers 45 are foreseen that consist of two 90° sectors or portions, which can be identified in a quarter circumference, arranged oscillating through respective motors 46 on supports 47. Such introducers 45 can be inserted above the tab 24 of the envelope, when open, and inside the mouth of the envelope at opposite sides and at the same end of the mouth itself, as shown in FIG. 11. The oscillation of such introducers 45 is commanded by the motors 46 with interposition of articulated parallelograms 53.

The supports 47 of the introducers can in turn be displaced towards and away from the sucked conveyor belt 35 in an essentially vertical plane, in other words towards and away from the mouth of the envelope 13 that is arranged on it. Such vertical displacement is commanded by a motor reducer 48 and by a levering 49 placed between it and the supports 47.

Downstream of the sucked conveyor belt 35 a hatch, schematised at 50, is also arranged for getting rid of envelopes 13 with printed products or sheets 12 not completely inserted or inserted in the incorrect amount or else envelopes that have partially broken during the inserting of products into envelopes operation.

A second hatch, schematised at 51, is arranged upstream of the conveyor belt 14 and 15 for getting rid of printed product or sheets 12 supplied in double the amount or of unsuitable sizes fed by the feeders or not fully released from such feeders (not shown) arranged upstream of the inserting of products into envelopes device. Finally, downstream of the actual inserting of products into envelopes zone, in other words after the hatch 50 and the sucked conveyor belt 35, a group 52 for flipping back and closing the envelope that also takes care of moistening the tab 24 of each envelope and arranging it to close the envelope over the mouth.

Hereafter, in particular with reference to the schematic figures that show the inserting of products into envelopes cycle, the operation of the device according to the present invention is described.

As stated previously, in such an initial step of the inserting of products into envelopes cycle, the printed product or sheets 12 are fed one after the other in the predetermined number by one or more feeders (not shown), arranged upstream of the inserting of products into envelopes device 11, between a pair of conveyor belts 14 and 15. At the same time, the envelopes 13 are also fed one after the other being picked up from the storage container 16 through the gripping element, in other words the suction cup 17 applied to the arm 18 oscillating about the pin 19. More specifically, each envelope 13 with the tab 24 opened by the blow 23 of the nozzle 22, is introduced between the conveyor belts 20 and 21 that face each other to define the feeding group of the envelope 13 towards the inserting of products into envelopes zone to receive one or more printed products according to the predetermined number. As shown by the figure illustrating the subsequent step, an envelope 13 with tab 24 open followed by a printed product or sheet 12 in phase with it, arranged between the conveyor belt 14 and 15, is thus arranged between the conveyor belt 21 and the conveyor belt 14. In an immediately subsequent step the envelope itself is advanced towards and above the sucked conveyor belt 35, whereas the displaceable end 37 of the conveyor belt 14 is pull backwards to define the opening 38 by the return of the cursor 27.

The immediately subsequent step sees the end of the arrangement of the envelope 13 above the sucked conveyor belt and the continuation of the backward movement of the displaceable end 37 with simultaneous advancing of the printed product 12. Also simultaneously, the downwards movement of the upper suction cup 40, the upwards movement of the lower suction cup 39 and the downward movement of the mobile introducers 45, or rather of their supports 47, begins through the activation of the respective motors 42, 41 and 48 and leverisms 44, 43 and 49.

The empty envelope 13 is thus completely arranged over the sucked conveyor belt 35 and locked onto it through the stopping of the conveyor belt itself 35. The upper suction cup 40 then reaches the mouth of the envelope 13, grips it, since a vacuum has been created inside it, and starts an upward movement. The lower suction cup 39 reaches the tab 24 of the envelope 13, grips it, since a vacuum has been created inside it, and starts a downward movement for it to be flipped back in the opening 38. The introducers 45, once their downward movement over the tab 24 of the envelope is complete, start their rotation to go inside the envelope or rather its opening through the activation of the motor 46.

As the operating cycle of the device continues the upper suction cup 40 finishes its upward movement completely opening the mouth of the envelope whereas the lower suction cup 39 finishes its downward movement lowering the tab 24 under the arrival plane of the printed product 12 and under the displaceable end 37 of the conveyor belt 14. The introducers 45 finish rotating inside the envelope 13 making a secure invitation for the printed product or sheet 12 that advances fed by the displaceable end 37 of the conveyor belt 14 that advances to close the opening 38.

The printed product or sheet 12, thanks to the continuous advance of the displaceable end 37, is introduced into the envelope 13 that is still stationary since the sucked conveyor belt 35 is still immobile.

The end of the advancing movement of the displaceable end 37 of the conveyor belt 14 carries out the complete insertion of the printed product into the envelope. It is at this point that the upper and lower suction cups 40 and 39, respectively, finish their suction action with the vacuum releasing the mouth and the tab of the envelope. Only then does the sucked conveyor belt 35 start moving again carrying the envelope 13 on it with the printed product 12 completely and correctly inserted, which is fed to the group 52 for flipping back and closing the envelope.

Another subsequent empty envelope 13 is arranged between the conveyor belts 21 and 14 ready to receive a respective printed product or sheet 12.

It should be highlighted that the conveyor belts of the device of the invention travel at a constant speed during their operation, with the exception of the sucked conveyor belt 35 that stops and starts according to that which has been described previously.

The variation in advancing speed of the conveyor belts, as well as in activation of the further auxiliary devices, allows adjustment of the device according to the varying of the size of the envelopes used for inserting of products into envelopes.

The device for the automatic inserting of products into envelopes made according to the present invention therefore does not have all the drawbacks that limited the functionality of known devices.

The presence of the conveyor belts and the arrangement between them both of the printed product or sheets and of the envelopes, above all in the step of feeding the printed products into the envelopes, solves the problems deriving from the printed products thrusted in known devices. Indeed, all of the problems deriving from folding or breaking of the printed products or sheets in the thrusting step are eliminated thanks to the feeding guided by the pairs of conveyor belts. It is therefore clear how simply and easily a solution to the general problem quoted previously has been found according to the present invention.

The device for the automatic inserting of products into envelopes of the present invention thus conceived is susceptible to numerous modifications and variants, which are al covered by the invention itself.

Moreover, in practice the materials used, as well as their size and components, can be whatever according to the technical requirements.

The invention claimed is:

1. Device (11) for the automatic inserting of printed products or sheets (12) into individual envelopes (13), feeders for feeding individual printed products or sheets (12), a storage container (16) for storing envelopes equipped with at least one gripping element (17, 18, 19), which grips and feeds a single envelope (13) between a first upper conveyor belt (20) and a first lower conveyor belt (21) facing each other to define a feeding group of the envelope (13) towards the inserting of products into envelopes zone, a second upper conveyor belt (15) and a second lower conveyor belt (14) facing each other to advance said printed products or sheets (12) one after the other, a nozzle (22) being associated with said first conveyor belts (20, 21) for opening and flipping back a tab (24) of the individual envelopes (13) taken out from the storage container (16), means for moving the downstream end (37) of said second lower conveyor belt (14) forwards and backwards over said tab and with respect to a sucked conveyor belt (35) aligned downstream of said second lower conveyor belt (14) to define an opening (38) of variable size between said end and said sucked conveyor belt, a gripping element (39) of said tab (24) at said opening at an initial portion of said sucked conveyor belt (35), a further gripping element (40) of a mouth of said envelope (13) locked onto said sucked conveyor belt (35) and mobile introducing elements (45) movable inserted over said tab (24) and inside said mouth of the envelope.

2. Device (11) according to claim 1, characterised in that said end (37) of said second lower conveyor belt (14) that can move backwards and forwards is made through a pair of rollers (25, 26) on which said conveyor belt winds in an S-shape that are arranged at the front of a cursor (27) capable of sliding horizontally below an upper branch of said second conveyor belt (14) that supports and advances both said printed products or sheets (12) and individual envelopes (13), whereas the remaining rollers on which the conveyor belt (14) winds are fixed with respect to the device.

3. Device (11) according to claim 2, characterised in that said cursor (27) is commanded into movement forwards and backwards on a guide (28) through a connecting rod (29) one end of which is hinged (30) to the cursor (27), and the other end is hinged (31) to a rotating disc (32) that is motorised (at 33, 34).

4. Device (11) according to claim 1, characterised in that said introducer elements comprise two 90° sectors or portions (45), which can be identified in a quarter circumference, arranged at opposite sides and at the end of the mouth itself.

5. Device (11) according to claim 4, characterised in that said two sectors (45) are arranged on supports (47) and oscillate through respective motors (46).

6. Device (11) according to claim 5, characterised in that said supports (47) can in turn move in an essentially vertical plane towards and away from said sucked conveyor belt (35) and towards and away from the mouth of the envelope (13), a motor reducer (48) and a levering (49) placed between it and said supports (47).

7. Device (11) according to claim 1, characterised in that said gripping element of said tab (24) comprises a lower suction cup (39) that is connected to a vacuum source.

8. Device (11) according to claim 1, characterised in that said further gripping element of a mouth of said envelope (13) comprises an upper suction cup (40) that is connected to a vacuum source.

9. Device (11) according to claim 7 or 8, characterised in that said gripping elements (39, 40) are actuated into their movement towards and away from the tab (24) and the mouth of the envelope (13), respectively, through motor reducers (41, 42) and levering transmissions (43, 44).

10. Device (11) according to claim 1, characterised in that said sucked conveyor belt (35) comprises a conveyor belt provided with holes, which in an upper branch thereof slides above suction cases (36) in which the vacuum is created.

11. Device (11) according to claim 1, characterised in that said at least one gripping element that grips each individual envelope (13) from said storage container (16) comprises at least one suction cup (17), connected to a vacuum source, applied to an arm (18) oscillating about a pin (19).

12. Device (11) according to claim 1, characterised in that downstream of the sucked conveyor belt (35) a hatch (50) is arranged to get rid of envelopes (13) with printed products or sheets (12) not completely inserted or inserted in the incorrect amount or else envelopes that have partially broken during the inserting of products into envelopes operation.

13. Device (11) according to claim 1, characterised in that upstream of said second conveyor belts (14, 15) a second hatch (51) is arranged to get rid of printed products or sheets (12) fed in double the amount or of an unsuitable size fed by the feeders or not fully released from such feeders.

14. Device (11) according to claim 1, characterised in that said first upper and lower conveyor belts (20 and 21, respectively) and said second upper and lower conveyor belts (15 and 14, respectively) travel at a constant speed during their operation, able to be adjusted according to the size of the envelope.

* * * * *